US008690031B1

(12) United States Patent
Blakley et al.

(10) Patent No.: US 8,690,031 B1
(45) Date of Patent: Apr. 8, 2014

(54) BACKPACK SYSTEM

(76) Inventors: Fabian M. Blakley, Odessa, FL (US); Beatrice J. Blakley, Odessa, FL (US)

( * ) Notice: Subject to any disclaimer, the term of this patent is extended or adjusted under 35 U.S.C. 154(b) by 822 days.

(21) Appl. No.: 12/592,004

(22) Filed: Nov. 18, 2009

Related U.S. Application Data

(63) Continuation-in-part of application No. 11/430,142, filed on May 9, 2006, now abandoned.

(60) Provisional application No. 60/403,678, filed on May 5, 2005.

(51) Int. Cl.
*A45B 11/02* (2006.01)

(52) U.S. Cl.
USPC ..... 224/190; 224/187; 224/645; 224/153

(58) Field of Classification Search
USPC ..... 224/186–190, 153, 154, 576, 645, 650, 224/652, 580, 644
See application file for complete search history.

(56) References Cited

U.S. PATENT DOCUMENTS 1,368,516 A * 2/1921 McCourt ..... 224/189
1,627,847 A * 5/1927 Harold ..... 224/187
1,803,538 A * 5/1931 Pistole ..... 224/187
4,112,957 A * 9/1978 Biven ..... 135/87
4,170,242 A * 10/1979 Caso ..... 2/410
4,179,053 A * 12/1979 Figura ..... 224/190
4,203,457 A * 5/1980 Friedman et al. ..... 2/410
4,251,015 A * 2/1981 Gale, Jr. ..... 224/154
4,563,777 A * 1/1986 Park ..... 2/108
4,687,414 A * 8/1987 Wardy ..... 416/63
5,445,301 A * 8/1995 Biedenharn, Jr. ..... 224/155
5,547,246 A * 8/1996 Lambert ..... 297/129
5,562,236 A * 10/1996 Monzingo ..... 224/153
5,586,703 A * 12/1996 Radar et al. ..... 224/601
5,628,437 A * 5/1997 Kober ..... 224/155
5,695,100 A * 12/1997 O'Brien ..... 224/160
5,743,448 A * 4/1998 Tsai ..... 224/153
6,024,264 A * 2/2000 Java ..... 224/576
6,076,539 A * 6/2000 Richardson ..... 135/20.1
6,247,482 B1 * 6/2001 Muis ..... 135/16
6,488,188 B2 * 12/2002 Fleischli ..... 224/153

* cited by examiner

*Primary Examiner* — Justin Larson
*Assistant Examiner* — Peter Helvey

(57) ABSTRACT

A frame assembly includes a base frame member, an upper frame member and a canopy frame member. Each of the frame members is fabricated of a rigid metallic tube in an inverted U-shaped configuration with a closed end and essentially parallel legs terminating in lower free ends. Pins pivotally couple the frame members with respect to each other adjacent to their free ends. The base frame member has a forward face with shoulder straps and a waist strap secured to the base frame member and extending forwardly for releasably coupling the base frame member to a carrier's back. A canopy sheet spans the canopy frame member and the upper frame member. A first pull cord has a fixed end secured to the canopy frame member and a second end extending forwardly of the base frame member for being pulled by the carrier to deploy the canopy frame member and the canopy sheet to an extended orientation.

1 Claim, 7 Drawing Sheets

BACKPACK SYSTEM

RELATED APPLICATIONS

This application is a continuation-in-part of U.S. patent application Ser. No. 11/430,142 filed May 9, 2006 now abandoned and claims the priority of U.S. Provisional Application Ser. No. 60/403,678 filed May 5, 2005, the subject matter of which applications is incorporated herein by reference.

BACKGROUND OF THE INVENTION

1. Field of the Invention

The present invention relates to backpacks and backpack accessories, more particularly to backpacks modified and constructed to enable the combined use of a backpack and an umbrella or canopy apparatus, wherein the combined apparatus is utilized hands fine in its preferred raised or collapsed position. A backpack which provides these uses along with common accessories such as; a plurality of storage compartments with various closing mechanisms, the option of forward and rearward fabric surfaces fabricated with water resistant material, a pair of shoulder straps and a waist strap associated with said forward surface along with other accessories that are not common such as; a u-shaped frame member secured within the rear outer walls of the backpack vertically and horizontally which provide structural rigidity to the entire assembly and serves as a base for the umbrella or canopy apparatus, a poncho which forms an integrated unit being connected to and stowed within a specific storage compartment on the bag portion of the backpack. A detachable; cushioned pillow also an accessory of the assembly structurally positioned to provide lumbar support for the carrier of the backpack and when detached can be used for sitting on hard services or a head rest while napping or sleeping etc. A final accessory is a carrying case that protects and preserves the entire assembly when being transported or stored, also fabricated optionally with a water resistant material wherein the fabrication and construction thereof enables the carrying case to convert in use to a mat for floor exercises, resting, napping etc. A complete assembly of the aforementioned having versatility in use by both genders of all ages for many different activities.

2. Description of Prior Art

The use of backpacks has been well established as an integral part of the daily lives of millions of people around the globe. Major contributing factors being the conveniences associated with the use of backpacks as well as the growing number of activities presently existing a person can engage in for which the use of a backpack enhances, whether it be recreational, educational, athletically, employment etc. This growing trend coupled with many technological advances has created a demand for backpacks that are constructed with durability, having versatility and still yet being suitable for use in multiple activities. The following prior art references among many other substantiates this fact.

U.S. Pat. No. 6/217,113 issued to Knatz on Apr. 17, 2001 depicts a carry all backpack modified with a seat conversion. U.S. Pat. No. 4,915,401 issued to Severon et. al. on Apr. 10, 1990 depicts a child carrier usable as a backpack, stroller and recliner. U.S. Pat. No. 5,409,152 issued to Trevino issued on Apr. 25, 1995 depicts a backpack assembly with audio components. U.S. Patent Application No. 20050258294 filed on Sep. 23, 2003 by Dickson, Craig C. suggests a backpack modified within to store the components of a tent. Lastly, U.S. Pat. No. 4,972,981 issued to Gex on Nov. 27, 1990 depicts a folding chair backpack.

These prior art references have mainly been fabricated to suit certain niche markets, and although not directly related to the preferred embodiment of the present invention, this referenced art does ascertain the need for modified multi-purpose backpacks. Now referring to prior art references that are more closely related to the present invention, such as; U.S. Patent App. No. 200400331827 filed on Nov. 8, 2002 by Haber, Robert suggests a backpack for carrying an umbrella and/or a child hands free. U.S. Patent App. No. 20050050614 filed on Jan. 17, 2004 by Leung, Kok Hung which suggests a backpack type satchel with a rain hat and connected cape. U.S. Pat. No. 6,053,385 issued to Ward et. al. on Apr. 25, 2000 depicts a backpack with umbrella support and U.S. Pat. No. 6,308,722 issued to Christie, Joseph L. on Oct. 30, 2001 depicts an umbrella mountable on a backpack. These prior art references suggest being versatile in use in different ways. However, they are either not suitable for use with adults and children alike, the operation thereof tends to be awkward for use, they are suitable for certain niche markets only, and they either fail to provide protection from the elements or the protection provided is inadequate in use when serious inclement weather.

SUMMARY OF THE INVENTION

In view of the problems and disadvantages presented in prior art, it is therefore the object of the present invention to provide a backpack and canopy combination wherein the canopy consisting of a fabric that can optionally be constructed of a water resistant material in which the canopy frame member and flange member function unitarily rotating pivotally between its preferred raised or collapsed positions. A combination that provides all of the mentioned advantages yet remaining fairly lightweight.

Another object of the present invention is to provide a backpack and canopy combination the wherein the canopy protects the carrier from harmful sunlight along with other inclement weather conditions and further provides a poncho connected within a storage compartment on the bag portion forming an integrated unit of the backpack assembly. The poncho being released when the carrier pulls upon a pair of straps attached to the storage compartment wherein the poncho is stowed, and said straps extended to the front portion of the assembly where attached to the shoulder straps. The poncho when worn by the carrier of the backpack covers and protects the front and rear bag portions along with the carrier of the backpack thus providing increased protection.

It is another object of this invention to provide a backpack and canopy combination that is quickly and conveniently deployed enabled by the use of straps that are symmetrically affixed to the lower extremity of the canopy frame. The straps extend to the front of the carrier where loosely secured through loops that are attached to the backpack shoulder straps, thus allowing the carrier to deploy the canopy by pulling downward on both straps simultaneously then securing the canopy in this position by means of clasp attached to end of these straps and the receiver for the clasp which are attached to the lower extremities of the shoulder straps. The canopy is easily retracted by releasing the clasp and pushing backward on the canopy frame member.

Still another object of the present invention is to provide a combination of the such wherein the canopy apparatus is supported by a separate frame secured within the backpack portion of the assembly. The backpack frame member also tubular has a U-shaped configuration which is secured within the outer back walls of the backpack where the horizontal tube member provides the base which merges into the vertical tube members that are parallel and the ends extend upward slightly above the surface of the backpack. The same vertically positioned frame members constructed to The backpack frame also provides structural rigidity to the backpack. The upper ends of the backpack frame are adjacently positioned beside the bottom ends of the canopy apparatus frame member symmetrically where the opposing sides are superimposed within a connecting device and secured there within by rivets.

Yet another object of the present invention is to provide a combination of the such having versatility in use yet durable and suitable for use in multiple activities. Importantly a backpack and canopy combination wherein the construction thereof provides all of the aforementioned advantages and capable to be used by individuals that are as young as elementary aged school students as well as adults of all ages.

It is also an object of the present invention to provide a backpack and canopy combination fabricated to include an attached pillow cushion structurally positioned to provide lumbar support to the carrier when transporting items of interest that are strenuous. The attached pillow cushion being connected by a clasp type fastening device that is attached to the backpack which allows easy detachment wherein the carrier can use the pillow cushion to sit upon, to rest the head while in an upright position or when lying down. The pillow cushion also having a fabric covering which allows the carrier to remove the covering and replace it or remove it and launder it.

A final object of the present invention is to provide a backpack and canopy combination is to provide a carrying case fabricated and constructed to provide protection and preservation of the entire assembly. A carrying case that allows the assembly to be stored and/or transported safely when not in use. To also provide a carrying case also fabricated and constructed with the ability to be converted into a mat. A mat that can used in combination with the detachable pillow while sleeping both indoors and outdoors, while relaxing, while exercising, camping or while engaging in several other activities. Thus providing with the present inventors complete assembly a backpack and canopy combination; a backpack that is durable, versatile in use, equipped for use in multiple activities, a completed assembly that is fairly lightweight, quickly raised or collapsed providing immediate protection from inclement weather, eliminating the problems common with prior art backpack and canopy combination.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 illustrates the canopy and poncho fully deployed. FIG. 3A illustrates the canopy fully deployed but with the poncho stowed. FIG. 3B illustrates the canopy and poncho stowed.

The same reference numerals refer to the same parts throughout the various Figures.

DETAILED DESCRIPTION OF INVENTION

Figure 1:
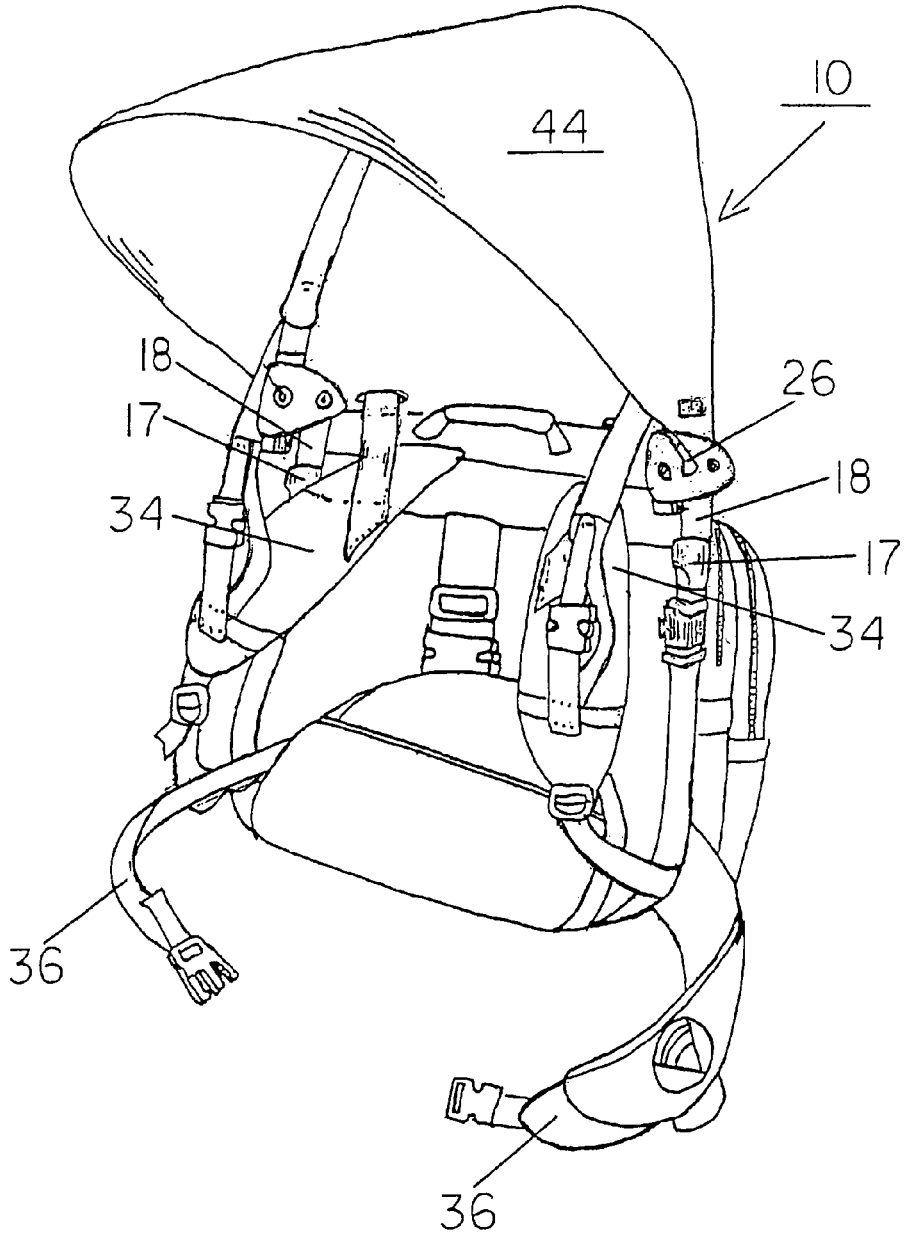
FIG. 1 is a perspective view of a backpack system with the canopy deployed, the system being constructed in accordance with the principles of the present invention.
Figure 1A:
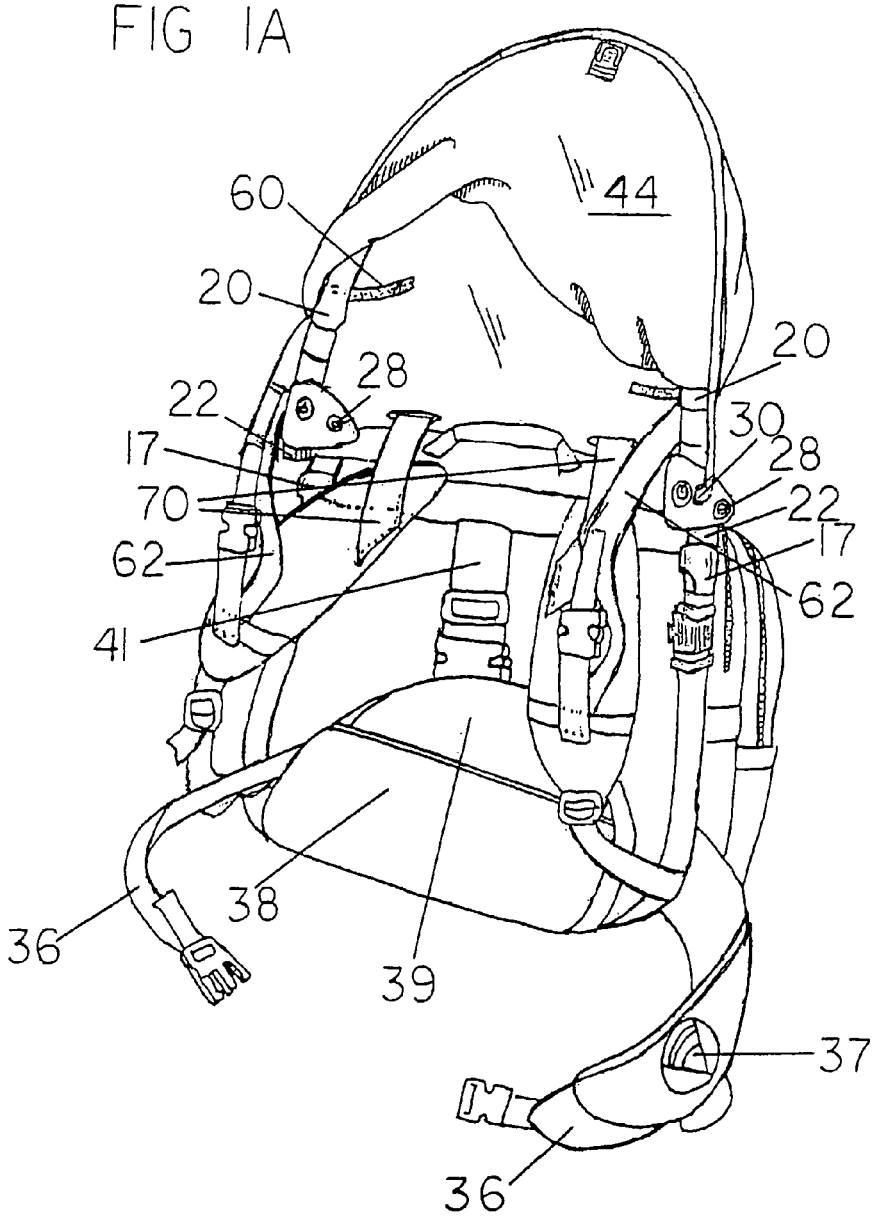
FIG. 1A is a perspective view of the backpack system shown in FIG. 1 but with the canopy only partially deployed.
Figure 1B:
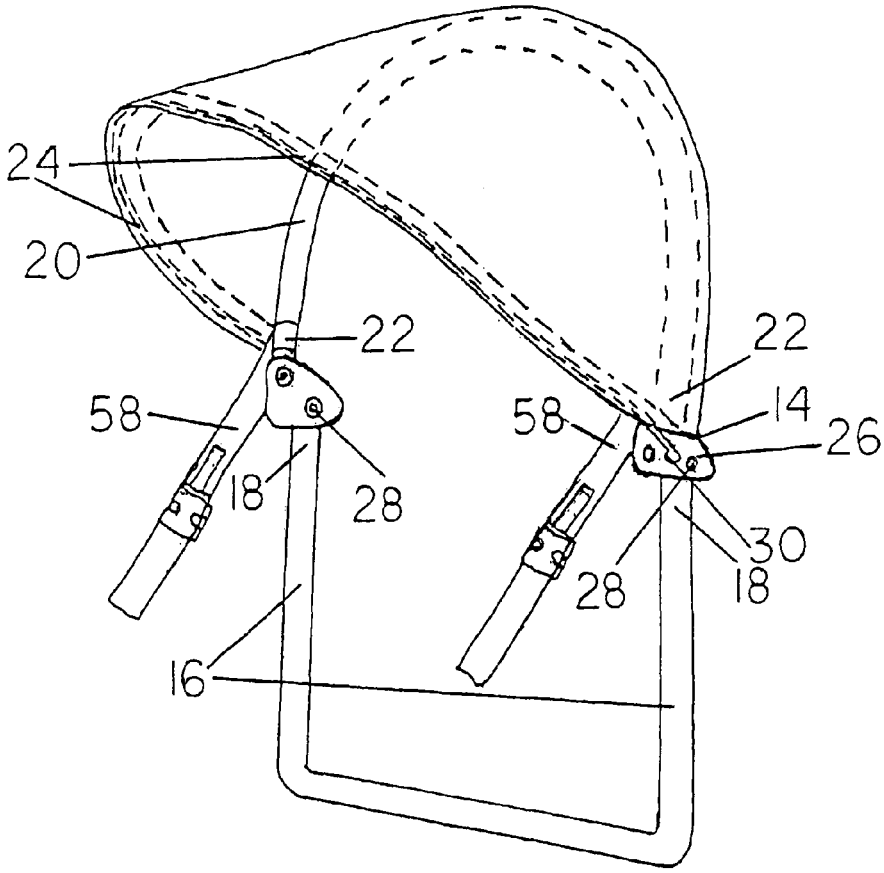
FIG. 1B is a front elevational view of the backpack system shown in FIGS. 1 and 1A with the canopy deployed and extraneous components removed for a clearer view of the frame members.
Figure 2:
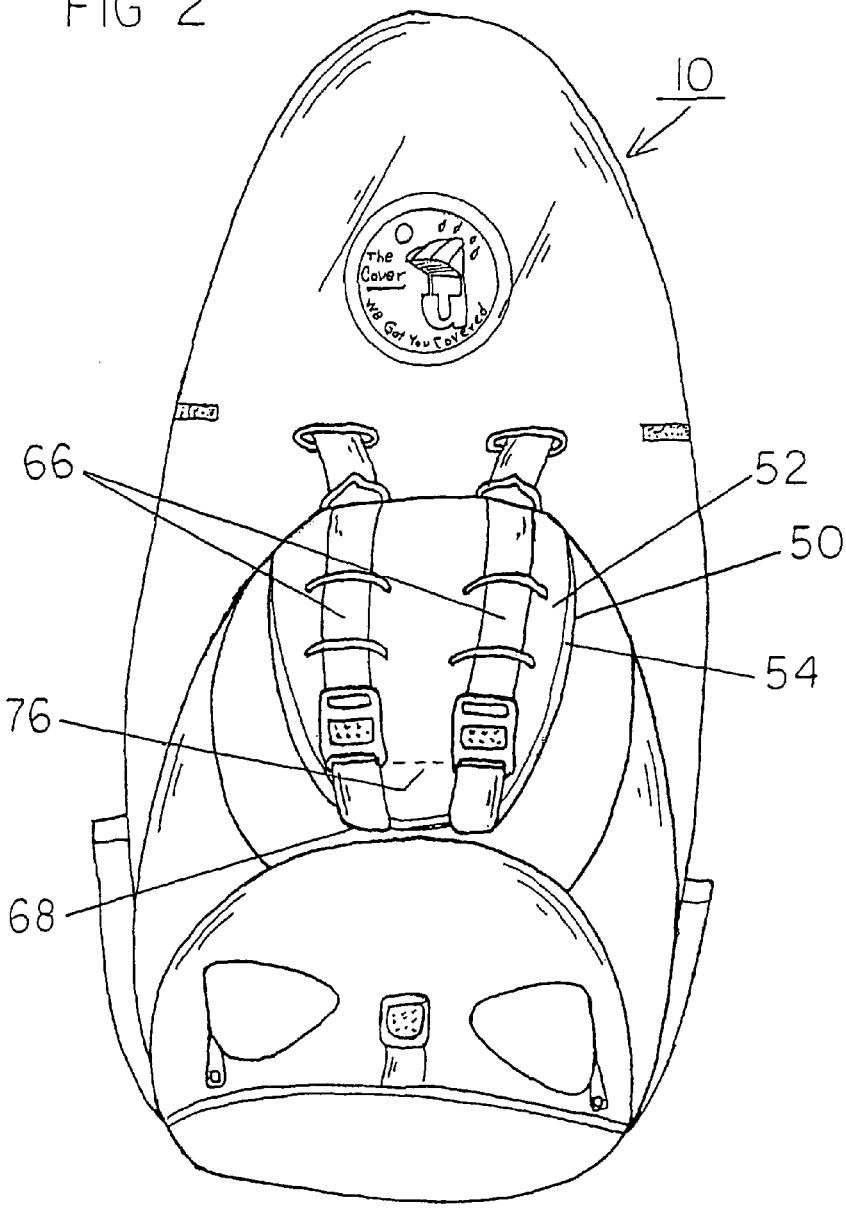
FIG. 2 is a rear elevational view of the backpack system as shown in the prior Figures.
Figure 2A:
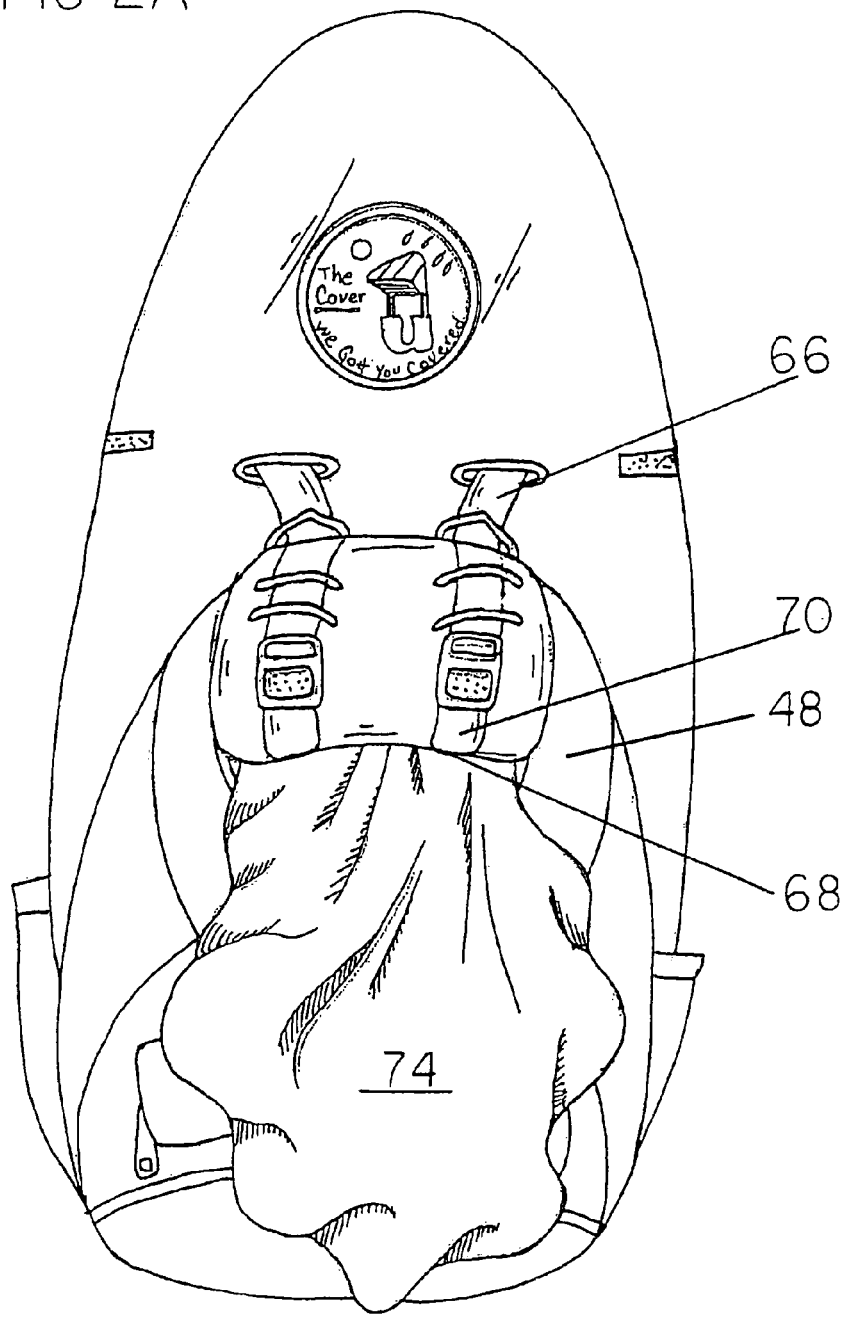
FIG. 2A is a rear elevational view of the backpack system similar to FIG. 2 but with the poncho partially deployed.
Figure 3:
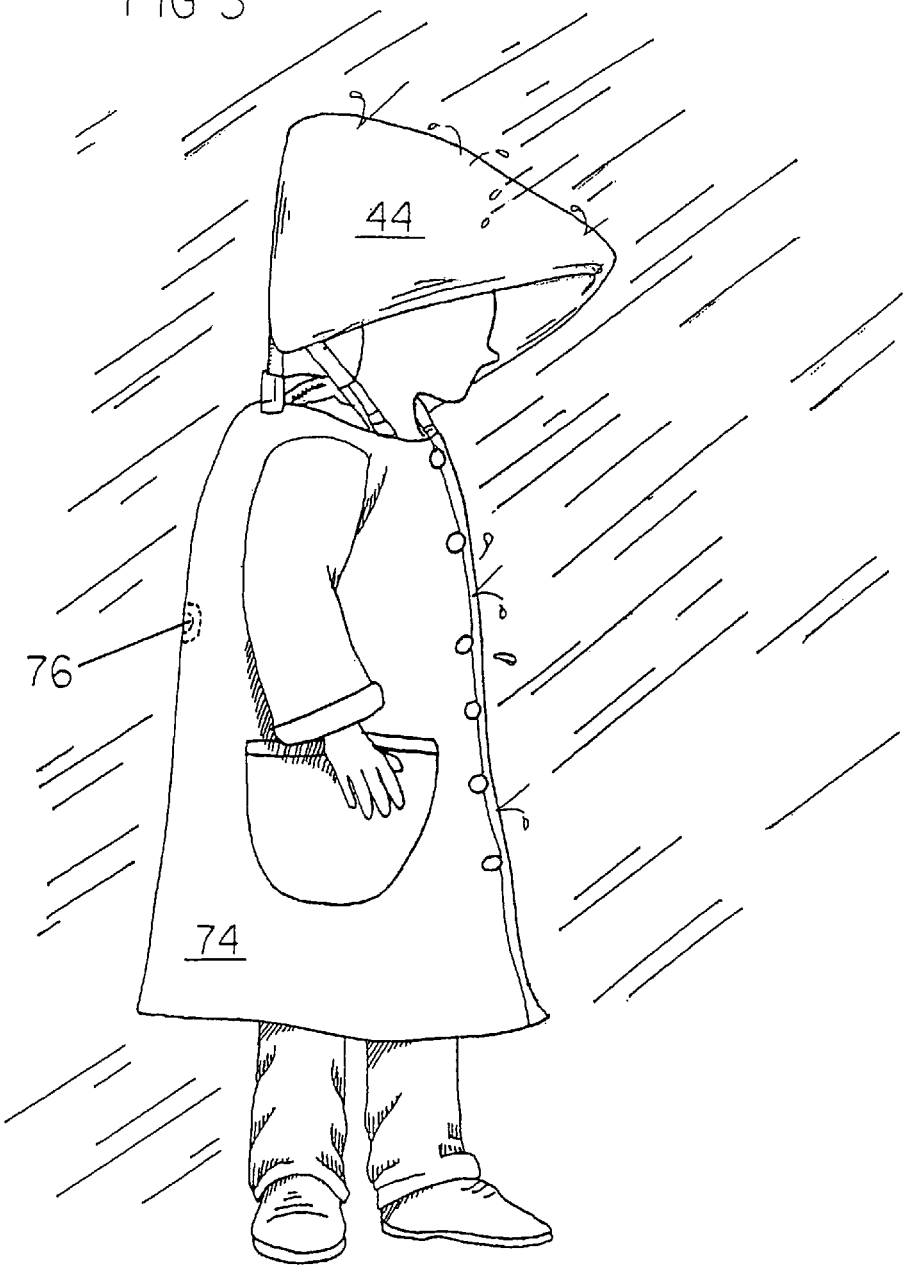
FIGS. 3, 3A and 3B are perspective illustrations of the backpack system as shown in the prior Figures.
Figure 3A:
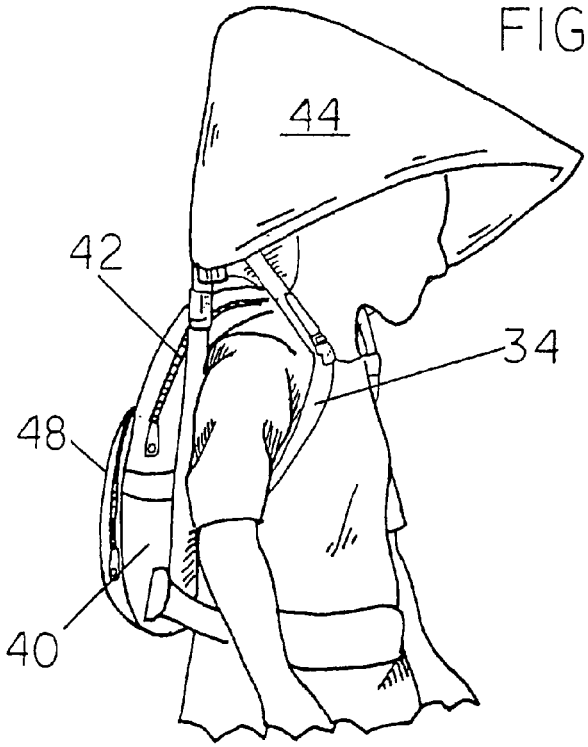
Figure 3B:
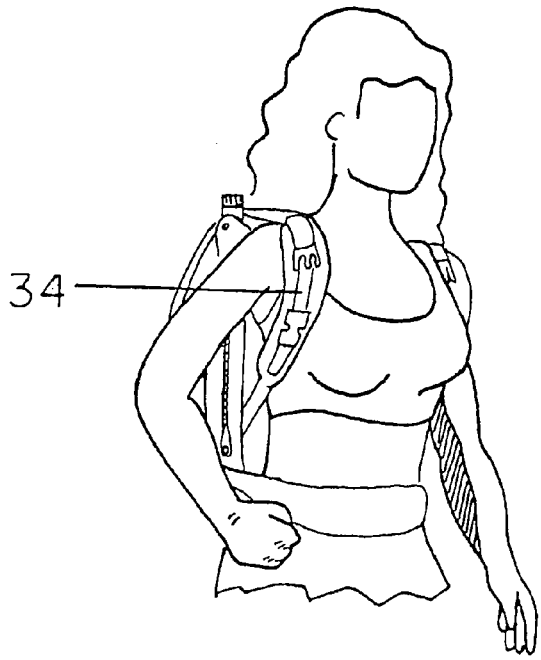

The preferred embodiment of the invention is shown in the figures. The backpack system 10 is for supporting and transporting personal objects as well as for providing comfort enhancing features which may be deployed at the discretion of a carrier of the backpack system. The supporting and transporting and deploying being done in a safe, convenient and economical manner.

First provided is a frame assembly 14. The frame assembly includes a base frame member 16 fabricated of a rigid metallic tube in a U-shaped configuration with a closed end and parallel legs terminating in upper free ends 18. Telescoping portions 17 below the upper free ends of the base frame member. The telescoping portions allow for vertical adjustment at the discretion of the carrier. The frame assembly also includes an upper frame member 20 fabricated of a rigid metallic tube in an inverted U-shaped configuration with a closed end and parallel legs terminating in lower free ends 22. The frame assembly also includes a canopy frame member 24 fabricated of a rigid metallic wire in an inverted U-shaped configuration with a closed end and parallel legs terminating in lower free ends 26. Primary pivot pins 28 pivotably couple the upper frame member adjacent to its free ends to the base frame member adjacent to its free ends. Secondary pivot pins 30 pivotably couple the canopy frame member adjacent to its free ends to the upper frame member adjacent to its free ends.

The base frame member has a forward face with shoulder straps 34 and a waist strap 36 secured to the base frame member and extending forwardly for releasably coupling the base frame member to the carrier's back during use. A cup holder 37 is formed in an enlarged portion of the waist strap.

Next, a pillow compartment 38 is secured to the base frame member and extends forwardly. The pillow compartment has an open top for holding a pillow 39. The pillow compartment is fabricated of a waterproof fabric. A releasable pillow strap 41 secures the pillow within the pillow compartment.

The base frame member has a rearward face with a major storage compartment 40 secured to the base frame member and extending rearwardly for holding personal objects. The major storage compartment is fabricated of a waterproof fabric with a zipper 42 for opening and closing access to interior of the major storage compartment.

Next, a canopy sheet 44 is provided. The canopy sheet spans the legs of the canopy frame member and the legs of the upper frame member. The canopy sheet is fabricated of a waterproof fabric.

The upper frame member is pivotable between a lower orientation adjacent to the base frame member and a raised orientation above and essentially co-planar with the base frame member. The canopy frame member is pivotable to a retracted orientation adjacent to the upper frame member when the upper frame member is lowered adjacent to the base frame member. The canopy frame member is pivotable to an extended orientation forward of the upper frame member while the upper frame member is in the raised orientation whereby the canopy frame member is over the carrier's head.

A minor storage compartment 48 is attached to and extends rearwardly from the major storage compartment. The minor storage compartment has an upwardly facing opening 50 with a flap 52 pivotable to open and close the opening. Hook and loop fasteners 54 releasably secure the flap over the opening.

Next provided are first pull cords 58. The first pull cords have fixed ends 60 secured to the canopy frame member. The first pull cords have second ends 62 extending forwardly of the base frame member for being pulled by the carrier to deploy the canopy frame member and the canopy sheet to the extended orientation.

Second pull cords 66 are next provided. The second pull cords have fixed ends 68 secured to the flap. The second pull cords have second ends 70 extending forwardly of the base frame member for being pulled by the carrier to open the minor storage compartment.

Lastly, a poncho 74 is removably positioned in the minor storage compartment for being deployed and worn by the carrier following opening of the minor storage compartment. Stitching 76 attaches a central extent of the poncho to within the minor storage compartment.

By way of further explanation, the frontal bottom portion of the canopy and backpack combination comprises a waist strap secured to the lower right and left sides of the bag portion and the ends of these strap members contain a clasp type fastening device commonly used on backpacks. The male and female ends connect and enable the strap member to be loosened or tightened. The shoulder strap members are attached to the top opposing sides of the bag portion and extend to the lower inner side edges of the bag portion and are therein attached. The length of the shoulder straps extend at the lower ends enabling the shoulder straps to be loosened or tightened to secure the assembly on the carriers body.

The front portion of the assembly further consists of canopy frame strap members. These straps are affixed to opposing sides lower extremities of canopy frame directly above the connection devices extending across the shoulders and thus attached to the front middle portion of the shoulder strap members. The canopy frame straps enable the canopy to be deployed to its raised position by pulling in a downward forward motion on the strap members. The canopy frame strap members are also fabricated to include elastic straps the top portions being connected to upper portion of the canopy strap members and the bottom portions and which are connected to the shoulder strap members and having elastic straps horizontally configured across the bottom elastic strap members which guide these strap members upward. The end tips of the elastic strap members have clasp type fastening devices, female ends and also male ends, enable the canopy to be secured in its raised position by connecting the clasp ends. To return the canopy to its collapsed or relaxed position, the clasp type fastening device is simply disconnected and the carrier can then slightly push the canopy frame on either side backwards. The canopy flange and frame members function unitarily in relevance to its movement between desired positions.

The frontal bag portion of the assembly also contains poncho strap members wherein said strap members are also attached to the shoulder strap members towards the upper portions of said shoulder straps. The poncho straps extend across the shoulders passing through slits in the appendage portion of water resistant fabric which is connected by seams doubled over and symmetrically attached to the outer rear surface of the canopy frame member wherein said fabric extend downward and connected by the same method of doubled over seams to the top rear of bag portion when viewing the assembly from the rear. The poncho strap members after extending from the front and passing through the slits on the appended fabric having minimal slack which allows the backpack carrier to pull on the straps from the front and release the poncho from its storage compartment located on the rear of the backpack assembly.

Velcro strips are attached by seams to both the right and left sides of the canopy frame fabric inner lower extremities when viewing the assembly from the front. The velcro strips are structurally positioned next to the connection devices wherein said strips cross horizontally over said connection devices symmetrically and connect to the strip bottoms and positioned symmetrically and attached by seams to lower extremities of said fabric when viewed from the rear. The canopy portion in the depicted upright position is thus stabilized in this position which allows hands free access to the bag portion and its accessories as desired. The canopy is then released by detaching said strips wherein the option to secure it in its collapsed position is available by attaching the aforementioned fastening device.

The upper canopy portion when viewed from the front comprises the semicircular flange member and the tubular canopy frame member, a water resistant fabric enveloping the flange members' complete outer surface connected by use of a doubled over seam formation. The material thus extends to the concave tubular canopy frame member where joined and connected with the aforementioned seam formation to the appended material on the rear of the canopy frame. The fabrication thereof allows rain to flow off the canopy without the carrier having rain flow down his back. The canopy frame further comprises a clasp type fastening device positioned within the canopy at the top center edge below the flange member. This fastening device of a typical clasp type is attached to the fabric with seams and is used to stabilize the canopy portion when in its collapsed relaxed position by attaching the top of clasp to the bottom of the clasp which is attached to the bag portion directly below the poncho storage compartment.

The upper and lower frame members form an assembly. The lower frame is of a tubular u-shape having vertical limbs which merge into the horizontal limb located at the lowest extremity. The upper extremity of the lower frame is constructed to be telescopic in nature enabling the height of the canopy up or down to a desired position by opening the locking mechanisms, and pushing and sliding upward or downward on the indents located above the locking mechanisms. Once the desired height is chosen the locking mechanisms are closed to secure the position. The upper frame comprises of a concave shaped tubular canopy member wherein the ends are capped to provide a smooth surface and the upper frame also consists of a semicircular flange member.

The canopy frame is depicted in its raised position. The upper canopy frame member and lower extremities along with the lower frame vertical limbs and top extremities are adjacently joined and superimposed by connection devices. Apertures enable the canopy frame member to be secured within the connection device with rivets. The flange member is received into apertures where the ends are flared within the connection device to secure its position, yet allowing the flange member to rotate pivotally between positions. Apertures also allow the lower flame vertical limbs to be secured within the connection device with rivets. Notches are structurally positioned adjacent to the flange member apertures to provide more stabilization to the flange member when the canopy is in its raised position.

A final member of the front lower portion of the assembly consists of a compact sized detachable cushioned pillow which comprises of foam having the shape of a miniature sized pillow enveloped by a water-resistant fabric fastened with doubled over seams wherein another piece of fabric which can optionally be water resistant also covers the pillow fastened by use of a zipper attached by doubled over seams which allows the top fabric layer to be washed and recycled or replaced. The cushioned pillow is structurally positioned on the bag portion of the backpack to provide lumbar support when the backpack assembly is being worn. Said pillow is thereby attached by seams to the bag portions top rear side by a strap member with the end thereof having a male fastening device end which connects to a female end attached to the top portion of the detachable pillow by strap member and a lower strap member affixed to the middle section of the horizontal limb of the lower frame member. Said strap has a female end fastening device which connects to a male end attached to the bottom of the detachable pillow by strap member. Said detachable pillow also has the ability to be detached and used for cushioned seating on hard surfaces and/or alternatively for resting or sleeping.

The bag portion comprises the lower u-shaped frame member previously described where secured within the outer walls of the bag portion by doubled-over seams that affix the bag portion to the frame members with a fabric material which is optionally water resistant. The bag portion has storage compartments along with small pockets and large pocket portions with zip fastener. Numerous variations can be used in the fabrication of the bag portion storage compartments pockets and fastening devices as seen in the plurality of backpacks that are commonly in use.

A last member of the rear bag portion comprises a poncho storage compartment wherein the poncho member which consists of a water resistant type material fabricated and constructed in the manner typically used to construct common basic ponchos and thus forms an integrated unit, the poncho member being attached to inner bottom portion of the poncho storage compartment of the backpack assembly. When the poncho is not in use it is stowed within the storage compartment. The upper portion of the storage compartment connects to the lower portion having Velcro strips and affix to the outer sides and outer bottom side of the lower storage compartment member by use of seams and thus connects to upper storage upper portion of the storage compartment having velcro positioned symmetrically on the inside of said upper portion of the storage compartment. The poncho is released from its storage compartment by the carrier pulling forward and downward on the poncho strap members which extend as previously described from the front portion where attached to the shoulder straps. The poncho straps pass through horizontal loop members on the right side and left side. The ends of the poncho strap members have male ends which connect to female ends that are attached and fastened to the top portion of the poncho storage compartment by the bottom strap portions.

The carrying case member, fabricated and constructed to provide protection and preservation of the backpack and canopy combination while being transported or stored, comprises a material that is optionally water resistant. The first layer is of the desired fabric material. The second layer is of a foam type cushion. The third layer is attached by use of doubled over seams that extend around the complete outer edges of the carrying case. Seams are also sewn across the carrying case creating three sections of equal length. An appendage of the same fabrication is joined at the top seam thus forming the area to safely store the assembly. Zippers are used to fasten the sides of the appendage to the top section of the carrying bag. Velcro strips are used to fasten the carrying case in its folded configuration having loop shaped handles comprised of a fabric material affixed by doubled over seams to the center on both the right and left sides of the carrying bag opening center sections.

What is claimed and desired to be protected by Letters Patent are described as follows:

1. A backpack system for supporting and transporting personal objects as well as for providing comfort enhancing features which may be deployed at the discretion of a carrier of the backpack system, the system comprising, in combination:

a frame assembly including a base frame member fabricated of a rigid metallic member in a U-shaped configuration with a closed end and parallel legs terminating in upper free ends, telescoping portions below the upper free ends of the base frame member adapted for vertical adjustment at the discretion of the carrier, the frame assembly also including an upper frame member fabricated of a rigid metallic member in a U-shaped configuration with a closed end and parallel legs terminating in lower free ends, the frame assembly also including a canopy frame member fabricated of a rigid metallic member in a U-shaped configuration with a closed end and parallel legs terminating in lower free ends, primary pivot pins pivotably coupling the upper frame member adjacent to its free ends to the base frame member adjacent to its free ends, secondary pivot pins pivotably coupling the canopy frame member adjacent to its free ends to the upper frame member adjacent to its free ends;

the base frame member having a forward face with shoulder straps and a waist strap secured to the base frame member and extending forwardly for releasably coupling the base frame member to the carrier's back during use, and a cup holder formed in an enlarged portion of the waist strap;

a pillow compartment secured to the base frame member and extending forwardly, the pillow compartment having an open top for holding a pillow, the pillow compartment being fabricated of a waterproof fabric, a releasable pillow strap for securing the pillow within the pillow compartment;

the base frame member having a rearward face with a major storage compartment secured to the base frame member and extending rearwardly for holding personal objects, the major storage compartment being fabricated of a waterproof fabric with a zipper for opening and closing access to interior of the major storage compartment;

a canopy sheet spanning the legs of the canopy frame member and the legs of the upper frame member, the canopy sheet being fabricated of a waterproof fabric;

the upper frame member being pivotable between a lower orientation adjacent to the base frame member and a raised orientation above and essentially co-planar with the base frame member, the canopy frame member being pivotable to a retracted orientation adjacent to the upper frame member when the upper frame members is lowered adjacent to the base frame member, the canopy frame member being pivotable to an extended orientation forward of the upper frame member while the upper frame member is in the raised orientation whereby the canopy frame member is over the carrier's head;

a minor storage compartment attached to and extending rearwardly from the major storage compartment, the minor storage compartment having an upwardly facing opening with a flap pivotable to open and close the opening, hook and loop fasteners releasably securing the flap over the opening;

first pull cords having fixed ends secured to the canopy frame member, the first pull cords having free second ends extending forwardly of the base frame member for being pulled by the carrier to deploy the canopy frame member and the canopy sheet to the extended orientation;

second pull cords having fixed ends secured to the flap, the second pull cords having second ends extending forwardly of the base frame member for being pulled by the carrier to open the minor storage compartment; and a poncho removably positioned in the minor storage compartment for being deployed and worn by the carrier following opening of the minor storage compartment, stitching attaching a central extent of the poncho to within the minor storage compartment.

* * * * *